US005729244A

United States Patent [19]

Lockwood

[11] Patent Number: 5,729,244

[45] Date of Patent: Mar. 17, 1998

[54] FIELD EMISSION DEVICE WITH MICROCHANNEL GAIN ELEMENT

[76] Inventor: Harry F. Lockwood, 21 White Oak Rd., Waban, Mass. 02168

[21] Appl. No.: 416,079

[22] Filed: Apr. 4, 1995

[51] Int. Cl.[6] ..... G09G 3/22

[52] U.S. Cl. ..... 345/74; 313/309; 313/310; 313/534; 313/528

[58] Field of Search ..... 345/74, 75; 315/12.1; 313/103 CM, 528, 534, 309, 310, 351, 336

[56] References Cited

U.S. PATENT DOCUMENTS

| | | | |
|---|---|---|---|
| 3,387,137 | 6/1968 | Adams | 313/528 |
| 3,424,909 | 1/1969 | Rougeot | 313/528 |
| 3,772,551 | 11/1973 | Grant | 313/534 |
| 3,868,536 | 2/1975 | Enck, Jr. | 315/12.1 |
| 3,902,240 | 9/1975 | Chang et al. | 313/534 |
| 3,904,923 | 9/1975 | Schwartz | 345/74 |
| 4,001,619 | 1/1977 | Endriz et al. | 345/74 |
| 4,001,620 | 1/1977 | Endriz | 345/74 |
| 4,030,090 | 6/1977 | Endriz | 345/74 |
| 4,051,468 | 9/1977 | Rajchman | 345/74 |
| 4,077,054 | 2/1978 | Endriz | 345/74 |
| 4,137,551 | 1/1979 | Rajchman | 345/74 |
| 4,978,885 | 12/1990 | White et al. | 313/103 CM |
| 5,086,248 | 2/1992 | Horton et al. | 313/103 CM |
| 5,378,960 | 1/1995 | Tasker et al. | 313/534 |
| 5,378,963 | 1/1995 | Ikeda | 313/103 |

*Primary Examiner*—Richard Hjerpe
*Assistant Examiner*—Kent Chang
*Attorney, Agent, or Firm*—Cesari and McKenna, LLP

[57] ABSTRACT

A field emission device with microchannel gain element provides a plurality of field emission or "cold" cathodes formed generally into an array. The cold cathodes are typically modulated by a grid having a driving voltage. A microchannel gain element is located adjacent the array of cathodes and provides a series of microchannels having a secondary electron emissive material within each of the channels. The channels correspond in number and location to the cathodes and enable multiplication of electrons emitted by the cathodes. Multiplication of the electrons enables the cathodes to be driven at a lower current of emitted electrons than normally applied, absent the microchannel, to obtain the same resulting beam. The beam exiting each of the microchannels is directed to an anode which can comprise a phosphor for use in a flat panel display.

22 Claims, 6 Drawing Sheets

FIELD EMISSION DEVICE WITH MICROCHANNEL GAIN ELEMENT

FIELD OF THE INVENTION

This invention relates to field emission devices and more particularly a field emission device utilizing a microchannel gain element to multiply electron emission.

BACKGROUND OF THE INVENTION

It has become increasing common in the construction of image-generating devices to utilize a field emission device or "cold" cathode as a source of electrons for exciting a surface that generates a visible light. The cathode is placed in a vacuum enclosure and electrons are emitted from the cathode by action of a strong electric field adjacent the cathode. The electric field results from the cathode's geometry and from the use of a collector or anode adjacent the cathode. The anode is biased with a strong positive electric potential relative to the cathode. The emitted electrons generate a beam that passes between the cathode and anode. This beam can be modified by a third electrode, known as a gate or grid. Further electrodes can also be added within the vacuum space between the cathode and the gate to further modify the electron beam. The resulting assembly can be termed a triode, tetrode, pentode, or the like, depending upon the number of electrodes present, in addition to the anode and cathode.

A generalized field emission device according to the prior art is detailed schematically in FIG. 1. The cathode 20 includes an emitter section 22 having a sharp emitter point 23. The emitter 22 is located behind a gate 24 having an opening 26 through which electrons pass to strike an anode 28. The cathode 20, gate 24 and anode 28 are separated from each other spacially and are enclosed in an evacuated envelope 30. Field emission or "cold" cathodes such as cathode 20 are known generally to those who are skilled in the art. Current methods of fabricating and characterizing these devices is described in a special issue of the Journal of Vacuum Science and Technology B, Microelectronics and Nanometer Structures, Second Series, vol. 12, no. 2, March/April 1994.

When the anode 28 of FIG. 1 is employed as a display device (such as in a flat panel display) a phosphor is provided integrally to the anode. The phosphor is sensitive to electron excitation and emits visible light. Likewise, the cathodes 20 are organized in arrays that are addressable to generate an image. Where the structure of FIG. 1 is to be employed in electron microscope, the object to be analyzed is part of the anode 28.

In a display device, the brightness of light emitted by the phosphor screen depends upon the density of electrons that strike a given area of the screen and the energy derived from the voltage difference between the anode and the cathode. The brightness also depends upon the efficiency of the phosphor in converting the energy of electrons to photons of visible light. Typically, to achieve a high current density, and therefore a high-brightness in a display device, the electric field that extracts electrons at the emitter 22 must be in the range of $10^7$ volts/centimeter. This high field strength invariably leads to cathode tip damage by erosion. Such erosion makes the emitted beam unstable in the short term and impairs long-term reliability. Thus, erosion makes construction of flat panel displays using the structure FIG. 1 impractical. Cathode damage and beam instability are also encountered in developing electron sources for integrated circuit lithography and electron microscopy.

IBM Research Report RC19596 (86076), Jun. 3, 1994, entitled "Emission Characteristics Of Ultra-Sharp Cold Field Emitters" (now published in the Journal of Vacuum Science & Technology, B12(6), p.3431, November/December 1994) by Ming L. Yu, et al describes cathode deterioration at high current densities due to ohmic power dissipation, electron static stress and ion etching from residual gases in the evacuated space. The report also relates to long term and short term current instabilities during electron emission at high current densities.

It is desirable that electrons emitted by each cathode be as concentrated as possible when used in a display device. Transverse spreading of electrons generates larger pixels and, thus, lowers the density of pixels on the screen. Spreading of the electron beam also results in noise and reduced contrast, since electrons strike the phosphor in an area other than the intended pixel. To combat spreading, displays according to the prior art have located the anode/phosphor screen as close to the cathode array as necessary to attain desired resolution, contrast and signal-to-noise ratio. However, the placement of the anode and cathode in close proximity makes construction difficult and imposes design constraints that increase construction cost and/or degrade performance.

While the cathode structure FIG. 1 can also be utilized in a color display device, by providing phosphors of three different colors (red, green and blue, for example) in a cluster with three independent emitters, the above-described problems remain. Additionally, accurate control of color generated by the three, clustered, subpixels must also be maintained. Electron beam spread and instability complicate the maintenance of good color fidelity.

In order to overcome the problems inherent in a field emission cathode operating at high current, it is contemplated that the cathode can be operated at a substantially lower current. However, a lower current, while reducing erosion and increasing electron beam stability, does not generate a beam of sufficient density. The resulting weak beam is typically insufficient to cause currently available phosphors to emit a bright visible light. The emitted electron beam is also insufficient to perform detailed electron microscopy or lithography adequately. Accordingly, it is an object of this invention to provide a field emission device structure that enables operation of a field emission cathode at a lower current without the corresponding loss in electron beam strength. The structure should be capable of tightly focusing the generated beam even when the anode is located at increased distance from the cathode. The cathode should generate a beam that triggers sufficient visible light emission in conventional phosphors. The generated beam should be stable and the cathode should have increased reliability due to reduced erosion.

SUMMARY OF INVENTION

A field emission device, with a microchannel gain element according to this invention, provides an array of field emission or "cold" cathodes located on a substrate. The cathodes can be addressed individually or in groupings that correspond, in an image display device, to pixels. A gate system is typically located in conjunction with the cathode array and is driven at a constant voltage with a superimposed modulating voltage to control emission of the cathodes. The cathodes are located in an evacuated space so that, upon application of a predetermined voltage, an electric field enables emission of electrons from individually addressed cathode emitters. The emitted electrons pass through the gate and, according to this embodiment, enter a microchannel gain element. The microchannel gain element includes a pair of opposing dynode sides that are driven at a voltage difference. The microchannel gain element also includes a plurality of microchannels that correspond to each of the cathodes. The microchannels include a secondary-electron-emissive layer therein. When electrons from each of the cathodes strike the emissive layer, the emissive layer generates additional electrons. A cascade effect ensues as electrons pass down each of the microchannels, and the resulting electron beam that exits each of the channels typically has a gain in a range of 100–200 (or more) relative to the entering electron stream. The use of a gain element enables the current generated by each of the cathodes to be substantially lower for a given anode current. This lower current adds to electron beam stability and reduces erosion of cathode emitters.

A substantially conventional anode is located adjacent the exit of the microchannel structure. The anode, in an image device, can comprise a glass plate having a phosphor and a thin metallic film thereon. Alternatively, in an electron microscope, the anode can include the object being viewed. In a photolithographic process, the anode can include a photolithographic plate or wafer.

In all of the above-described embodiments, the use of a microchannel gain element enables generation of more-stable electron beams and increases cathode reliability and life. Overall power consumption is also reduced. The microchannel plate according to this invention can be formed in a variety of ways from a variety of materials. The construction lends itself to photolithographic processes and enables the formation of a large density of small-diameter microchannels that enable the formation of high resolution pixels. An image display device according to this embodiment can be constructed in a either a monochromatic gray scale or as a color display.

BRIEF DESCRIPTION OF THE DRAWINGS

The foregoing and other objects and advantages of the invention will become more clear with reference to the following detailed description as illustrated by the drawings in which.

DETAILED DESCRIPTION OF THE PREFERRED EMBODIMENT

Figure 1:
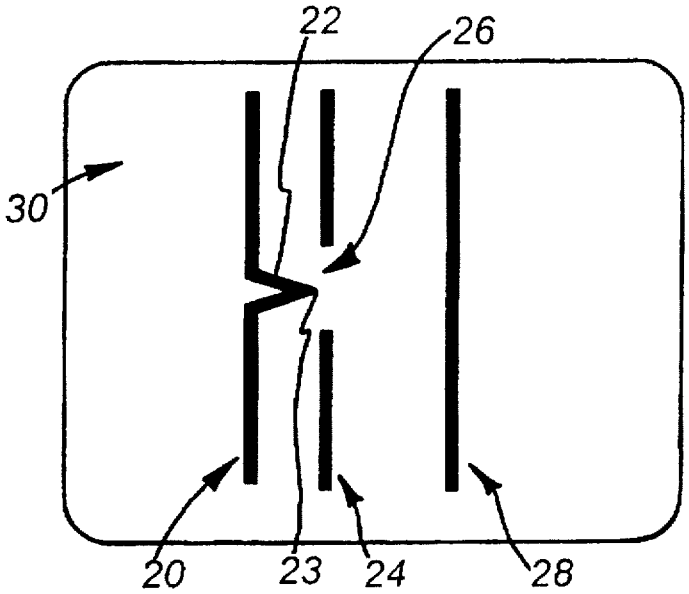
Fig. 1 (PRIOR ART)
FIG. 1 is a schematic cross-section of a field emission device according to the prior art.
Figure 2:
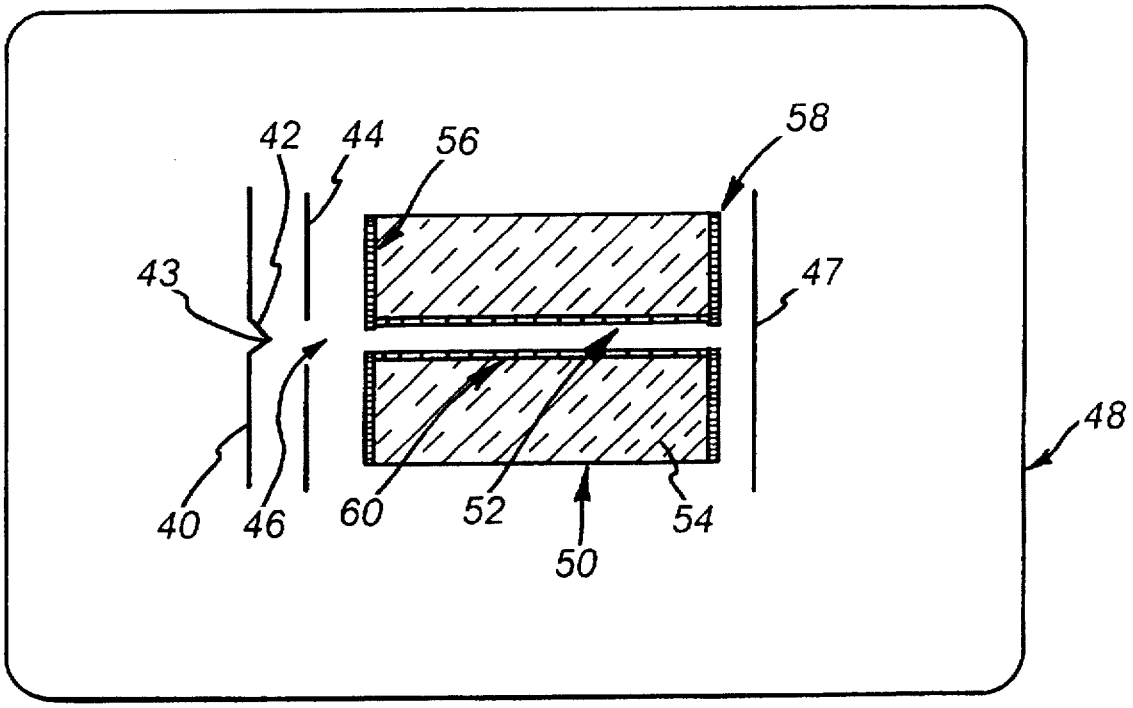
FIG. 2 is a schematic side view of a field emission device including a microchannel gain element according to this invention.

FIG. 2 illustrates a basic embodiment of a field emission device with microchannel gain element according to this invention. The cathode 40 includes an emitter structure 42 formed conventionally according to this invention. A conventional gate structure 44 having an opening 46 is provided in conjunction with and adjacent the cathode 40. Some examples of field emission device cathodes, typically containing sharply tipped points, are structures formed from metal such as molybdenum, nickel or tungsten deposited on, for example, glass or silicon. Diamond can possibly be employed, and materials such as gallium nitride and metal carbides have been investigated as possible cathode structures.

The cathode includes an emitter tip 43 that is pointed to generate a very high local electric field. Shaping of the tip 43 is accomplished by etching and/or depositing a tip of material or forming a thin ridge with a sharp edge on the active region. Cathodes will emit electrons in a vacuum when excited with grid voltages ranging from less than 10 volts (the Matsushita Tower Cathode, for example) to approximately 150 volts. The emission voltage depends largely upon materials and geometry. The electric field requisite for emission is approximately $10^7$ volts/cm. An anode 47 is provided remote from the cathode 40. The anode is typically a thin conducting film such as vapor-deposited aluminum. As noted above, the anode can include a phosphor for emitting visible light in a display device embodiment. Alternatively, the anode 47 can comprise an object being viewed through an electron microscope or a photolithographic plate. By "anode" it is meant a display screen, photolithographic plate, microscopic object or any other structure intended to selectively receive beams of electrons. It can be assumed that a plurality of cathodes 40 and emitters 42 are provided in, for example, a panel display. The entire structure is surrounded by a vacuum envelope 48 that can comprise glass or a similar sealed structure. Between the grid 44 and the anode 47 is located a microchannel structure 50. It is the microchannel that enables multiplication of electrons emitted by the cathode emitter 42 according to this invention.

The microchannel 50 includes a series of through passages such as channel 52. Each channel is located adjacent an emitter 42 so that emitted electrons are aligned with the channel 52. The channel according to this invention is typically in the range of 0.1 to 1 millimeter in length and approximately 2 to 10 microns in diameter. The channel can be constructed with a body or substrate 54 of silicon, glass, metal (such as aluminum) or another suitable base material. The front and rear surfaces of the channel, adjacent the grid 44 and the anode 47 are coated with conductive electrodes 56 and 58, respectively. The coating typically consists of a conductivity modifier, dopant or vapor-deposited material applied to the body material The construction of a microchannel display according to this invention is described further below.

Within the surface of the microchannel 52 is disposed a secondary electron emissive layer 60 according to this invention. The electrodes 56 and 58 are driven at a constant voltage potential (between each other) ranging from approximately 600 to 1000 volts according to this embodiment. The driving of the microchannel 50 at this voltage will generate a gain in the range of approximately 100 to 200 times.

Figure 3:
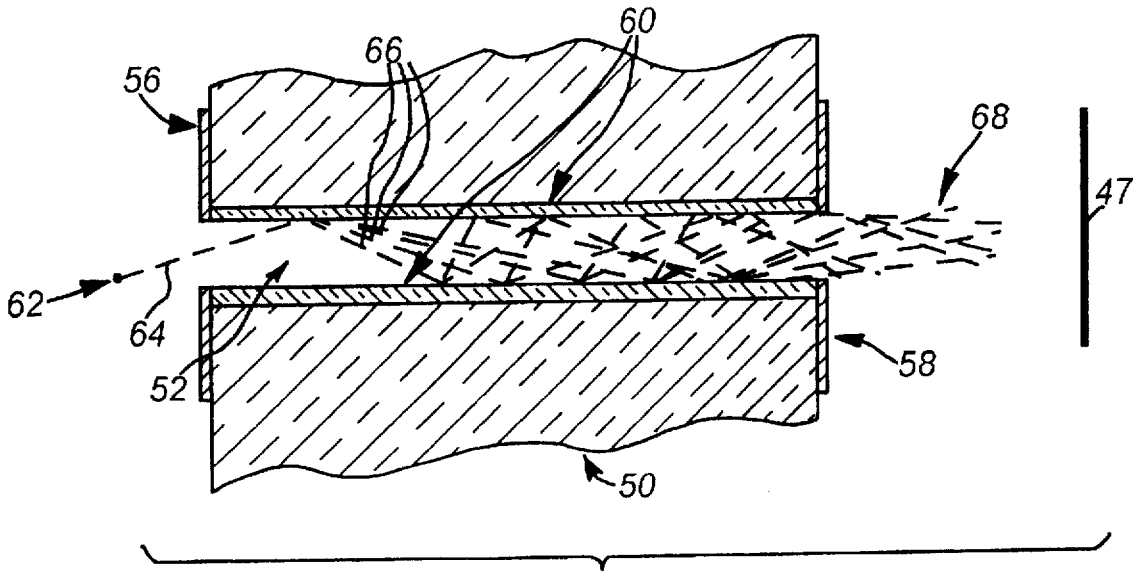
FIG. 3 is a schematic cross-section of the microchannel gain element of FIG. 2.

Operation of the microchannel 50 is detailed more particularly in FIG. 3. An electron 62 enters the channel 52 along a path 64 shown as a dotted line. When the electron 62 comes into contact with the secondary electron emissive layer 60 (sometimes referred to as a dynode due to the analogous dynode structure in a photomultiplier tube), the electron causes the emission of a plurality of electrons that, typically, project along a series of paths 66 to each strike the emissive layer 60, yet again. Each emitted electron that strikes the emissive layer 66 again generates a further multiplicity of emitted electrons forming a continuously cascading group of electrons that finally exits the channel 52 as a multiplied electron beam 68. As noted, this multiplication can be substantially more than 100 to 200 times. The resulting beam 68 is formed of a large number of energized electrons that, according to this embodiment, are sufficient to cause a phosphor to glow brightly as the beam's electrons are collected at the anode 47.

A practical application of a microchannel 50 according to this embodiment entails the use of an array of such microchannels, known as microchannel plates. Microchannel plates were originally developed for image intensifier tubes in night vision application. Because of the gain generated by the microchannel plate, the anode current can be may orders of magnitude greater than the current emitted by the cathode. The gain can be as much as $10^8$. Hence, low-light images focused on a photocathode are transferred to an anode/screen with a much higher intensity. In a night vision application, the source of electrons is a photo-sensitive cathode rather than a field emission cathode as described herein. Light incident upon the photo-sensitive cathode causes the emission of electrons, usually from a surface that is specially coated with a material having a negative electron affinity. The low-intensity image that originates at the cathode is, thus, transferred to the viewing screen after intensification resulting from amplification in the microchannel plate.

Microchannel plates in current use have typically been fabricated from arrays of microscopic glass cylinders with a channel density of between $10^5$ to $10^7$ per square centimeter. Galileo Electro-Optics Corporation is a manufacturer of glass microchannel plates. Details related to the Galileo microchannel plates are described by J. J. Fijol, et al in "Secondary Electron Yield of $SiO_2$ and $Si_3N_4$ Thin Films for Continuous Dynode Electron Multipliers", Applied Surface Science 48/49, pp 464–471 (1991). Fabrication techniques for these microchannel plates has been disclosed in U.S. Pat. Nos. 5,086,248 and 5,205,902, which are expressly incorporated by reference herein. Galileo has most recently developed a microchannel plate based upon silicon rather than glass. Details of the silicon plate's fabrication are reported under NIST ATP Contract Number 70NANB3H1371. Fabrication details for a silicon microchannel plate are also reported in "Characteristics and Applications of Advanced Technology Microchannel Plates" by J. R. Horton, et al. in SPIE, vol. 1306, Sensor Fusion III (1990).

Construction of a microchannel plate according to this invention typically entails the slicing, grinding and fine polish of a wafer of substrate material. The wafer is subsequently coated with a photoresist and exposed by photo lithography to generate a series of microscopic holes in the photoresist along a surface of the wafer. The holes are then exposed to a chemical etching process that etches away the substrate material within the confines of each hole to form a through-channel. A conductive layer is then formed over the surfaces of the wafer and in each channel. This conductive layer is applied, typically, by vapor deposition. Subsequently, an electron emissive layer is applied into the channels. As a final step, a metal surface is evaporated onto the opposing sides of the wafer to generate the dynode. Each wafer is typically inspected and tested prior to installation in a predetermined device.

Figure 4:
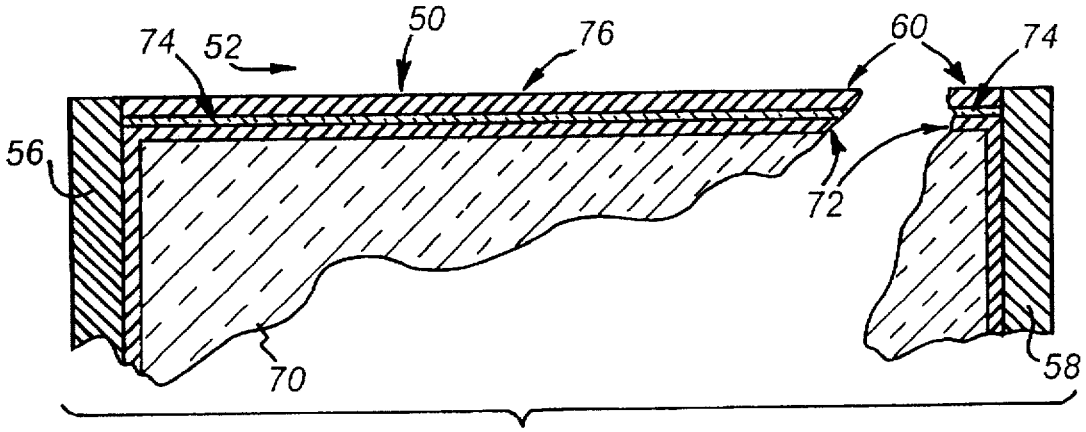
FIG. 4 is a more detailed partial schematic cross-section of the microchannel gain element of FIG. 3 illustrating the substituent layers thereof.

With reference to FIG. 4, it is contemplated that silicon can be used as a substrate 70 for a microchannel plate 50 according to this embodiment. Since silicon acts as a conductor even when it is nearly intrinsic, a high voltage across the length of the channel 52 would draw very high current and adversely affect operation of the microchannel plate 50. Accordingly, the underlying silicon substrate 70 is isolated from the applied voltage by an insulator that, in this embodiment, comprises an oxynitride film 72. Since $SiO_2$ and $Si_3N_4$ are both good secondary electron emitters, this film 72 could act as an electron emitter. However, if there is no continuous conducting path for the current path, the secondary emission current cannot be sustained and no amplification would occur. Thus, a thin conducting film 74, which can comprise amorphous silicon or another material, is deposited on the oxynitride 72 within the channel 52. This layer 74 provides a resistive bridge between the two dynodes while the oxynitride layer 72 insulates both the dynodes and the resistive "bridge" layer from the silicon substrate 70. Note that the lower insulating layer is typically unnecessary when the substrate comprises an insulator, such as glass.

A further layer of emissive oxynitride 76 is then deposited over the conductive layer 74. A high voltage is generated along the length of the resistive layer 74 due to its continuity with the deposited end conductors 56 and 58. The specific design of the conducting film 74 is generally specific to the microchannel plate application. For example, in an image intensifier, it is desirable that the anode current comprise only a small fraction of the current carried by the resistive film in the channel of the microchannel plate. In other words, the conductance of the film should be relatively high. High conductance avoids any non-linearity in the response of the microchannel plate and assures faithful reproduction of the object viewed to a resulting image. In a field emission device application, however, it can be desirable to avoid excess (parasitic) current in the resistive film to minimize power dissipation. As such, the resistive film 74 should typically exhibit lower conductance so that at least some saturation of the output current may occur.

Figure 5:
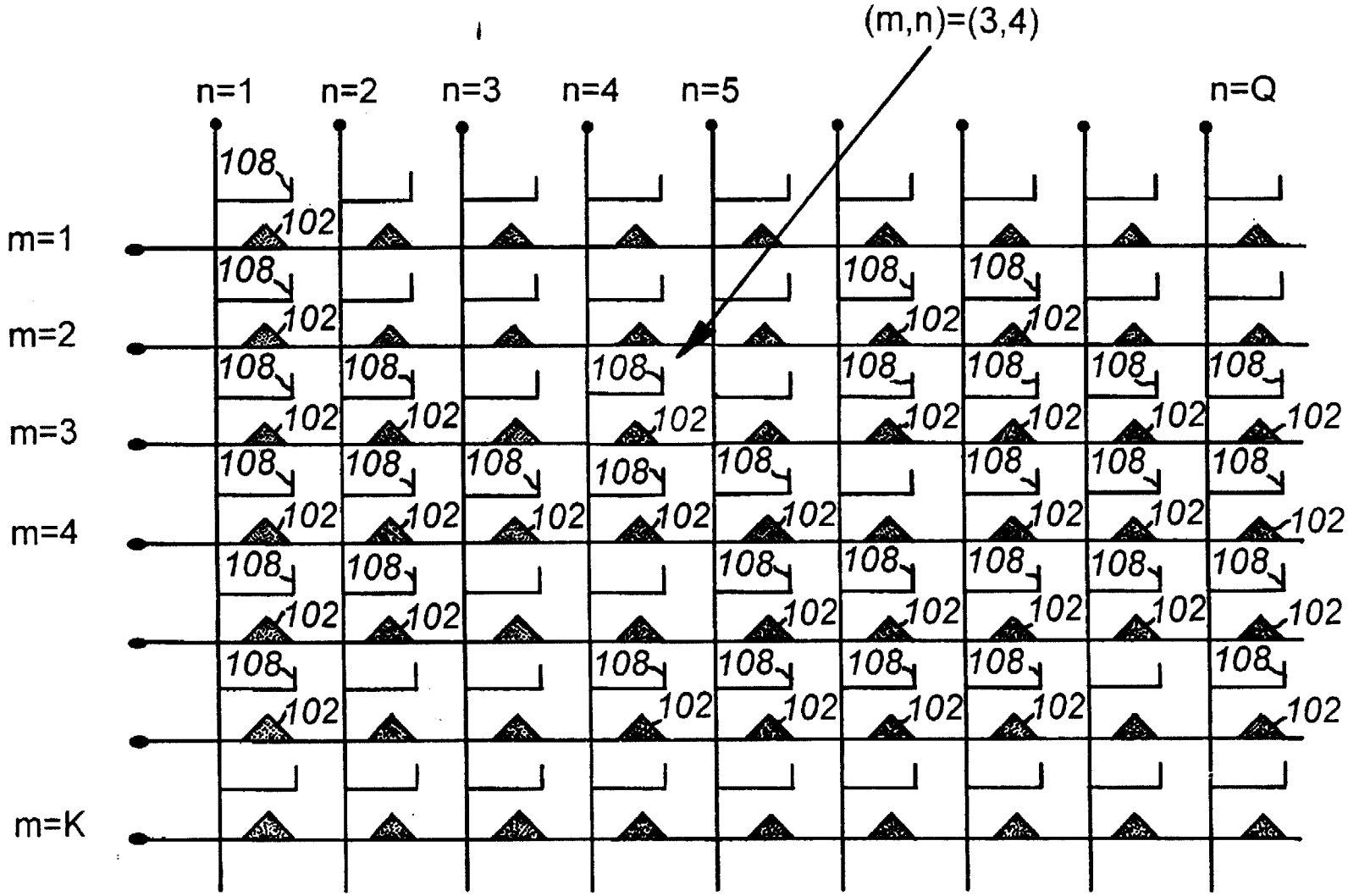
FIG. 5 is a schematic diagram of an array of field emission cathodes according to this invention.
Figure 6:
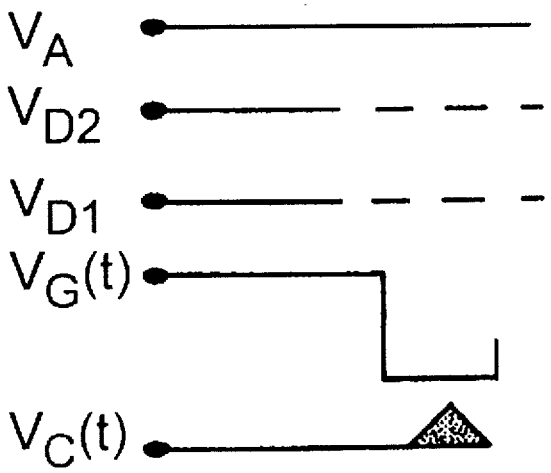
FIG. 6 is a voltage and timing diagram relative to the array of FIG. 5.
Figure 7:
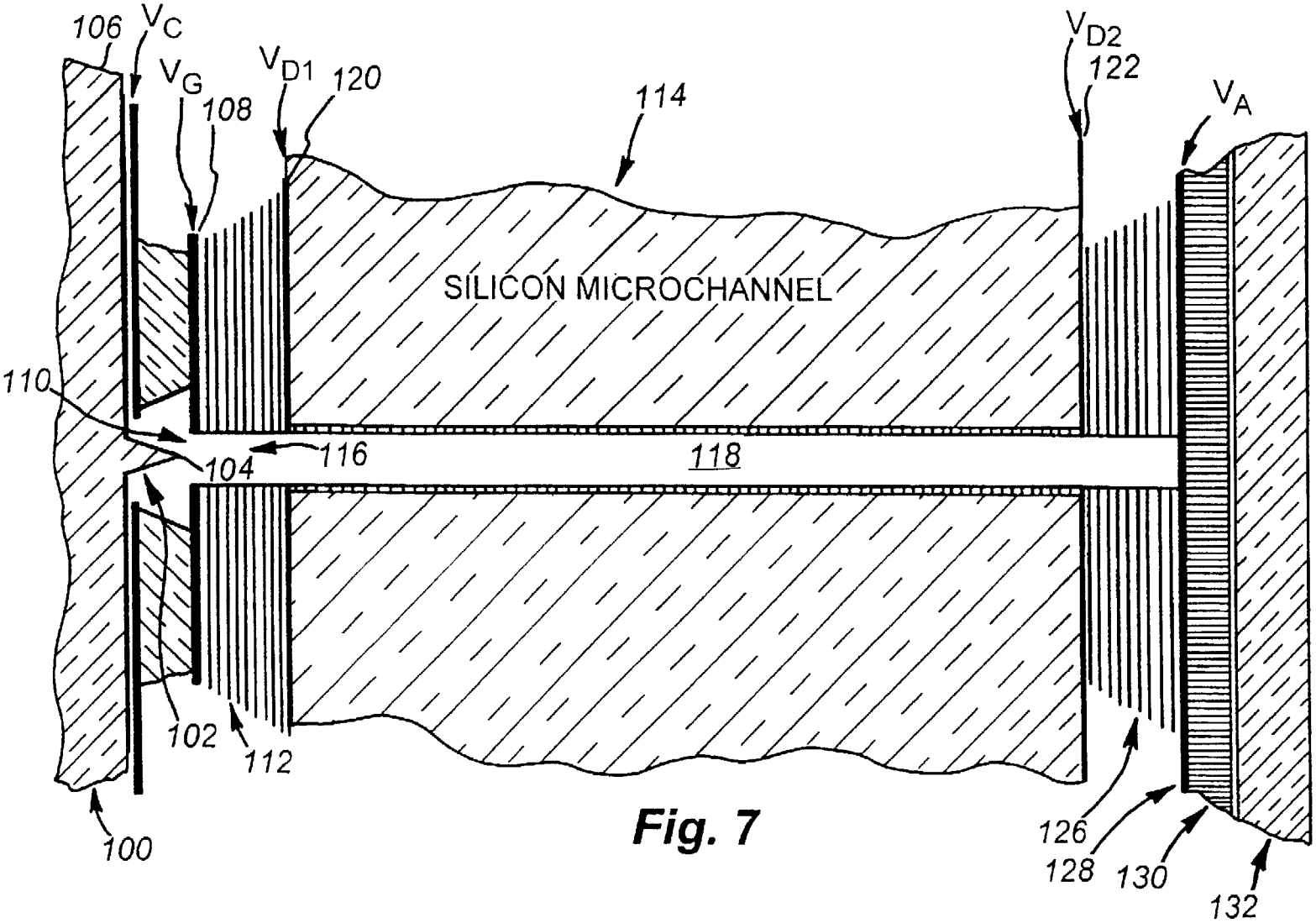
FIG. 7 is a schematic cross-section of a field emission device with a microchannel gain element installed in a flat panel display according to this invention.

FIGS. 5, 6 and 7 illustrate a specific implementation of the above-described field emission device with microchannel gain in a flat panel display. With reference to FIG. 7, the cross-section of a single emitter and channel is shown. It can be assumed that a practical flat panel display according to this invention would comprise a large array of such emitter and channels all located within an evacuated space. The details of such a display are described further below. The emitter structure detailed in FIG. 7 can comprise a single pixel of the display. Where color is utilized, it is desirable to have three individual subpixels that direct an electron beam onto three distinct phosphors that glow (for example) red, green and blue, respectively. It is contemplated that each subpixel can, in fact, consist of many emitters that each include a corresponding microchannel element. Thus, the term "pixel" as used herein is meant to include a plurality of constituent subpixels and/or emitter and microchannel structures.

As described further below, with reference to addressing, each redundant emitter for a given subpixel is electrically connected in parallel. Similarly, for a monochromatic display, each monochromatic pixel can be formed from many emitters in parallel. It should be clear that one advantage of forming a single pixel from a plurality of emitters is that the failure of any one, or group, of emitters will not generally render the pixel inoperative.

FIG. 7 details a generic design for a single pixel or subpixel in a flat panel display according to this invention.

The cathode 100 includes an emitter 102 that in this embodiment includes a pointed emitter tip 104. The emitter 102 is disposed on a substrate 106 that can comprise a plate having a plurality of cathode emitters 102 formed thereon. It is contemplated that each of the cathode emitters 102 is independently addressable by interconnections formed within the substrate 106 using, for example, photolithographic circuit-forming techniques. As discussed above, a variety of known "cold" cathode structures can be used according to this invention. The difference between currently used field emission devices and the field emission device contemplated according to this invention is that the current derived from the cathode can be reduced by at least two orders of magnitude due to the amplification provided by the microchannel element. A grid 108 having a grid opening (gate) 110 is provided at the front of the cathode with the opening 110 aligned with the emitter 102. The grid facilitates modulation of the current from the cathode. Typical grid voltages can vary from between 8 volts to 140 volts. The grid typically is biased at a constant voltage with a superimposed modulating voltage to achieve a desired emission of electrons from the cathode 102. The exact voltage used to drive the grid depends upon the performance of the cathode 106 and the gain obtained by the microchannel, as well as the sensitivity of the phosphor (so that an appropriate brightness is achieved for a given cathode current). A low grid voltage can enable the use of low-voltage CMOS drivers to drive the system and thus, can be preferable from a manufacturing and power consumption standpoint.

A spacer 112 is positioned between the grid 108 and the microchannel element 114 according to this invention. The thickness of the spacer 112 is a design option. The spacer 112 includes a channel 116 that enables electron flow from the cathode into the microchannel 118 of the microchannel element 114. The spacer 112 can comprise any suitable insulating material.

The microchannel element 114 includes opposing conductive dynode plates 120 and 122. A constant voltage differential of between 600 and 1000 volts is applied between the plates 120 and 122. The associated gain for the channel 118 will then be in the range of 100 to 200. A further spacer is provided adjacent plate 122. This spacer 126 is, again, a design option, but can be constructed of any appropriate insulating material. Adjacent to the spacer 126 is the anode structure 128. The anode 128 includes a phosphor element 130 that glows visibly in response to electron excitation. The phosphor element 130 is disposed upon a transparent plate 132 that can comprise glass according to this invention.

The construction of the phosphor element 130 and glass screen 132 can be identical to that of any conventional flat panel display. Industry is currently experimenting with numerous low-voltage phosphors for field emission device applications. The availability of low voltage phosphors that have efficient excitation and voltages of 100–200 volts would enhance the performance of a flat-screen display according to this invention. However, it is contemplated that existing high-efficiency phosphors can be utilized according to this invention.

Since the gain of the channel 118 is in the range of 100 to 200, for a given anode current, the cathode current will be approximately the same factor of 100 to 200 lower than without the presence of the microchannel element 114. Any excess current flowing through the microchannel element 114 that does not contribute to anode current is considered parasitic. However, designing a current saturation point into the microchannel output to enhance uniformity serves to lower the excess current and assures minimum dissipation. Excess saturation should be avoided if it is desired to display a gray scale or color where variable brightness (due to variable electron current) is required.

As discussed above, the flat panel display according to this invention comprises a large array of cathode emitters 102 with corresponding microchannels 118 each directed to a portion of a phosphor element 130 on a screen 132. Each pixel (which can be composed of a single emitter or a plurality of parallel-connected emitters) is individually addressable. For an exemplary ten inch diagonal full-color display, having VGA resolution, the following parameters are contemplated:

Display area: (10 inch diagonal): 280 square centimeters;

Pixel pitch (at most) 300 microns between each pixel;

Pixel area: $9\times10^{-4}$ square centimeters;

Number of pixels: 300,000 (monochromatic);

Number of addressable subpixels: 900,000;

Number of cathodes for each subpixel: 3 (redundancy for enhanced reliability); and Total number of cathodes and microchannels: 2,700,000.

For an average screen (anode) current of 1 milliamp, the average current-per-cathode, in the absence of microchannel plate would be 370 picoamps (1 milliamp/2,700,000). Using a microchannel plate, biased to a gain of 100, the average current-per-cathode would be reduced to 3.7 picoamps (generally within an order of magnitude between 1–10 picoamps), with a corresponding reduction in driver voltage. The net power is approximately 1 watt (1 milliamp×1000 volts). In comparison, a backlighted active matrix liquid crystal digital display (AMLCD) consumes up to eight watts. Most of this power consumption is attributable to the fluorescent backlight.

With further reference to FIGS. 5 and 6, a basic addressing scheme for a display according to this invention is disclosed. To address any number of pixels in a dynamic manner, the timing of voltages applied to the cathode, gate, microchannel plate an anode must be controlled. Generally, the anode and microchannel plate can be held at constant voltages that are positive with respect to the gate and cathode. The gate and cathode are modulated to control cathode current. With reference again to FIG. 7, the voltages at each of the cathode 106, gate 108, conductive dynode surfaces of the microchannel plate 120 and 122 and anode 128 are $V_C$, $V_G$, $V_{D1}$, $V_{D2}$ and $V_A$ respectively. The voltage scheme is generally $V_A>V_{D2}>V_{D1}>V_G>V_A$, with $V_A$, $V_{D1}$, and $V_{D2}$ held constant $V_G$ and $V_C$ variable in time for the purpose of addressing individual pixels. As noted above, individual color pixels consist of three subpixels, one each for red, green or blue according to this embodiment. Additionally, each subpixel may consist of many emitters, each with a corresponding microchannel element. These redundant emitters within a subpixel are, typically, electrically connected in parallel. In a monochromatic display, subpixels are not normally included, but each pixel can comprise many emitters in parallel as in a color display. Alternately, clustered emitters could be each separately addressable to control the brightness of a given pixel by, for example, activating a given number of clustered emitters at a given time to generate a corresponding brightness level based upon the number emitters.

As depicted, the array comprises a series of interconnected rows (m) and columns (n) of emitters 102 and gates 108 that are each individually addressable. As noted above, it can be assumed that a multiplicity of emitters can be connected in parallel for any given row (m) or column (n) subpixel. The total number K of rows and total number Q of columns vary depending upon the density of pixels and size of the display.

With reference to FIG. 6, at time t=0 the raster of rows (m) is initiated by applying a voltage to the cathodes common to the first rows (m=1) for a duration T1. Any emitter 102 in the row can then be activated by applying a voltage during the same time interval to the intersecting gate column (n) corresponding to the emitter to be activated. The voltage difference $V_G-V_C$ at the emitter 102 must exceed the threshold voltage necessary to initiate the flow of current from the cathode. Note that there will also be a small but significant contribution to the net field at the cathode from voltages applied to the microchannel plate 114 and the anode 128. Thus, to activate an emitter 102 at any given raster cycle, there must be present at that time an adequate field at the cathode derived from the applied voltages, especially those at the cathode and gate 108.

The timing for addressing an individual emitting element depends partly upon the properties of the phosphor 130. In particular, the persistence of the phosphor 130 will determine the raster rate at which the individual subpixels must be refreshed in order to avoid flicker in the display. Thus, T1 must be less than the duration of the raster cycle but sufficiently long that the intensity of a subpixel does not appear to decrease before it is refreshed on the subsequent raster scan. If the subpixel is not to be addressed on the subsequent raster scan, however, T1, in combination with the persistence of the phosphor column must not be so long as to produce "ghost" images.

Figure 8:
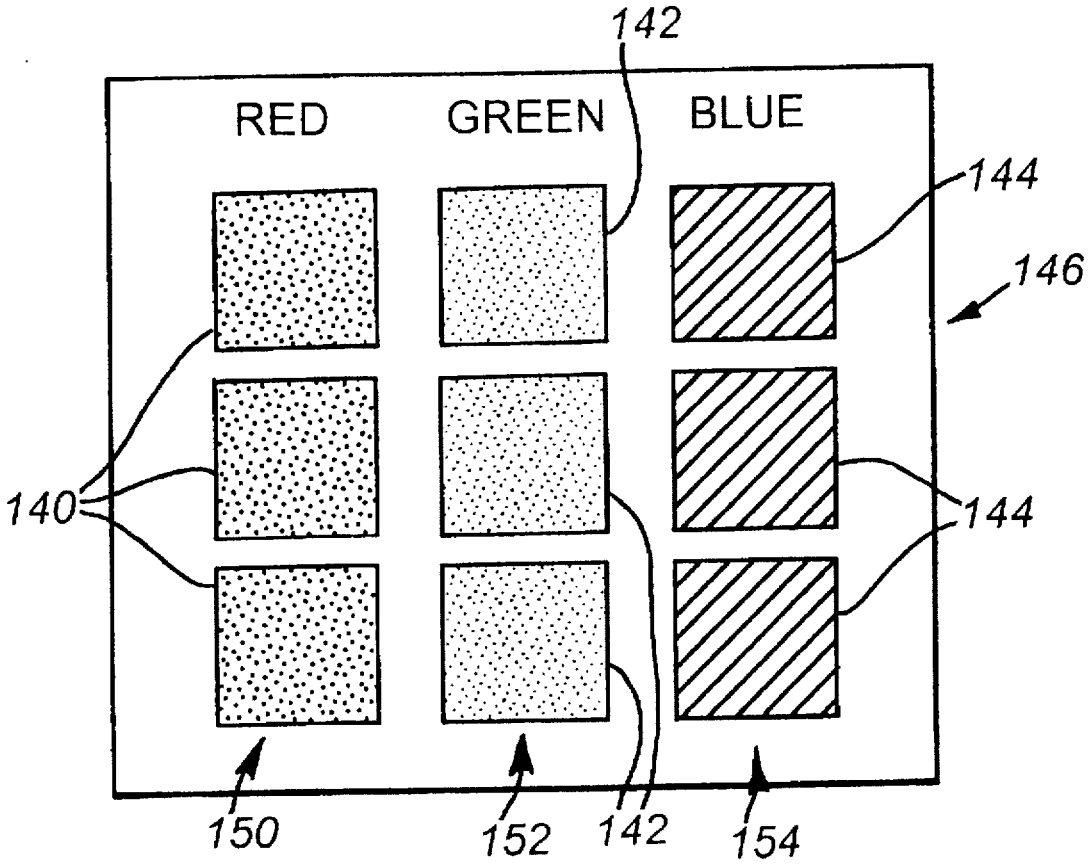
FIG. 8 is a schematic plan view of a grouping of primary color subpixels for use in a color display according to this invention.

With reference, finally, to FIG. 8, there is shown a schematic array of subpixels 140, 142 and 144 of a pixel 146 for use in a color display. The subpixels 140, 142, 144 are arranged in three side-by-side columns, corresponding to the primary colors red 150, green 152 and blue 154, respectively. Each subpixel column is composed of three parallel subpixels of like color. Each subpixel can receive electrons from one or more cathode emitters. It is contemplated that a larger or smaller number of subpixels can be utilized and that the subpixels can be organized in rows, columns or another clustering arrangement (such as triangles) relative to each other. The screen phosphor should be processed and aligned in a manner that corresponds with the desired pixel color. In this embodiment, each pixel (146) has a pitch relative to other pixels (not shown) of approximately 300 microns. The pitch between subpixels is approximately 90 microns.

The foregoing has been a detailed description of a preferred embodiment of this invention. Various modifications and additions are contemplated without departing from the spirit and scope of this invention. Accordingly, this description is meant to be taken only by way of example and to otherwise limit the scope of the invention. For example, the principles described herein in FIGS. 5, 6 and 7, while related to a flat panel display, can be applied with modifications to other imaging devices such as an electron microscope or a photolithography device. The parameters of the microchannel, gate structure and cathode structure could be altered to meet the specific needs of an electron microscopic of photolithographic environment.

What is claimed is:

1. A field emission device comprising:

a vacuum enclosure;

a plurality of field emission cathodes for generating a plurality of streams of electrons in the vacuum enclosure, each of the plurality of field emission cathodes comprising a tapered emitter tip constructed and arranged to define a local electric field at the tip;

a gate structure positioned relative to each of the field emission cathodes for modulating the stream of electrons generated by each of the field emission cathodes, thereby varying the current of each of the streams;

a microchannel gain element, located so that the gate structure is positioned between the plurality of field emission cathodes and the microchannel gain element, the microchannel gain element having a first dynode side adjacent the gate structure, an opposing, second dynode side and having a plurality of microchannels each located adjacent each of the plurality of field emission cathodes for providing a gain to each of the streams of electrons, each of the microchannels having a continuous emissive layer disposed on an internal surface thereof, the emissive layer extending between each of the first dynode side and the second dynode side, each of the first dynode side and the second dynode side being separated by a predetermined distance and defining therebetween a bias voltage differential that is equal with respect to each of the plurality of microchannels; and an anode positioned adjacent the second dynode side, the anode absorbing electrons from each of the plurality of streams of electrons.

2. The field emission device as set forth in claim 1, wherein the anode comprises a transparent screen having phosphor thereon.

3. The field emission device as set forth in claim 2, wherein the phosphor includes locations that glow in each of three primary colors in response to excitation by each of the plurality of streams of electrons.

4. The field emission device as set forth in claim 1, wherein the microchannel gain element includes a plurality of microchannels each having a secondary electron-emissive layer therein and wherein each of the first dynode side and the second dynode side of the microchannel gate element include a conductive material thereon having a voltage difference therebetween.

5. The field emission device as set forth in claim 4, wherein the microchannel element comprises a plate having a substrate constructed from glass.

6. The field emission device as set forth in claim 4, wherein the microchannel comprises a substrate constructed from silicon.

7. The field emission device as set forth in claim 6, wherein the microchannel gain element includes an insulating layer located thereon and along a surface of each of the microchannels and wherein each of the first dynode side and the second dynode side are insulated from the substrate by the insulating layer and further comprising a resistive bridge layer interconnecting each of the first dynode side and the second dynode side and the resistive bridge layer being insulated from the substrate by the insulating layer.

8. The field emission device as set forth in claim 4, wherein the microchannel comprises a substrate constructed from a metal.

9. The method as set forth in claim 8 wherein the metal comprises aluminum.

10. The field emission device as set forth in claim 1, comprising at least 2,000,000 field emission cathodes.

11. The field emission device as set forth in claim 1, wherein the plurality of field emission cathodes comprise groupings that correspond to a plurality of pixels and wherein the anode comprises a display for displaying the pixels.

12. The field emission device as set forth in claim 11, wherein the display is constructed and arranged to display at least 300,000 pixels.

13. The field emission device as set forth in claim 1, wherein each of the first dynode side and the second dynode side of the microchannel gain element are driven at a predetermined voltage and wherein a difference between the predetermined voltage on each of the first dynode side and the second dynode side is in a range between approximately 600 and 1000 volts.

14. A method for providing gain to a field emission device comprising:

selectively energizing a plurality of field emission cathodes each having a tapered emitter tip in a vacuum enclosure to generate a plurality of respective streams of electrons in the vacuum enclosure, the step of selectively energizing including defining an electric field for generating a stream of electrons on each of the tapered emitter tips by modulating a gate structure having a first gate side adjacent the plurality of field emission cathodes and a second side opposite the first gate side;

applying a gain to each of the streams of electrons with a microchannel gain element adjacent the second gate side, the microchannel gain element having a first dynode side, an opposing second dynode side and a plurality of microchannels extending between the first dynode side and the second dynode side, the step of locating including aligning respective openings of the microchannels that are on the first dynode side adjacent a respective of each the plurality of field emission cathodes;

locating, in the vacuum enclosure, an anode adjacent the second dynode side;

applying a bias voltage differential between the first dynode side and the second dynode side, the voltage differential being substantially equal with respect to each of the plurality of microchannels, to produce a gain in a current of each of the streams of electrons passing through each of the microchannels, the streams of electrons each increasing in current as the streams strike an emissive layer disposed continuously on each respective of the microchannels between the first dynode side and the second dynode side; and wherein each of the streams having a gain strikes the anode at a predetermined location thereon.

15. The method as set forth in claim 14 further comprising locating a phosphor on the anode and producing a visible light on the phosphor at predetermined locations where each of the streams having the gain strikes the anode.

16. The method as set forth in claim 15 further comprising locating each of the plurality field emission cathodes and each of the plurality of microchannels in an array and addressing each of the plurality of field emission cathodes in a selected order at selected times to produce an image on the phosphor.

17. The method as set forth in claim 16 wherein the step of providing a phosphor includes providing a phosphor that glows in at least three primary colors in response to contact by selected streams of electrons thereonto.

18. The method as set forth in claim 17 wherein the step of addressing includes grouping each of the plurality of cathodes on each of the microchannels into discrete pixels for forming an image and wherein the step of grouping includes locating pixels at a pitch corresponding to less than or equal to 300 microns.

19. The method as set forth in claim 18 wherein the step of locating pixels includes providing at least 300,000 pixels.

20. In a display device having an anode screen with a phosphor that is excited by electron streams corresponding to individual pixels and a plurality of field emission cathodes each having a tapered emitter tip that increases a local electric field for generating electron streams, a gain device for providing amplified electron streams to the screen comprising:

a gate structure having a first gate side located adjacent the plurality of field emission cathodes and a second gate side opposite the plurality of field emission cathodes, the gate structure being constructed and arranged to individually modulate each of the electron streams to vary a current thereof;

a microchannel structure, located in a vacuum enclosure between the field emission cathodes and the anode, the microchannel structure having a plurality of microchannels that include a continuous secondary electron-emissive layer therein the layer extending between a pair of opposing dynode sides, one of the dynode sides being located adjacent the gate structure and the other of the dynode sides being located adjacent the screen; and a microchannel-driving voltage source connected to each of the pair of dynode sides for providing a bias voltage differential to generate a gain in a current of each of the electron streams passing from the field emission cathodes through respective of the microchannels to the screen, and wherein the microchannel-driving voltage is substantially equal with respect to each microchannel.

21. The gain element set forth in claim 20 wherein the voltage differential is in a range of approximately 600–1000 volts.

22. The gain element as set forth in claim 20 wherein each of the field emission cathodes generates a current of the order of 1 picoamp.

* * * * *